US012606221B2

(12) United States Patent
Prim

(10) Patent No.: US 12,606,221 B2
(45) Date of Patent: Apr. 21, 2026

(54) DATA COMMUNICATION SYSTEM, COMPUTER-IMPLEMENTED METHOD FOR DATA COMMUNICATION IN A RAILWAY NETWORK, COMPUTER PROGRAM AND NON-VOLATILE DATA CARRIER

(71) Applicant: DELLNER BUBENZER AB, Borlänge (SE)

(72) Inventor: Viktor Prim, Sandviken (SE)

(73) Assignee: DELLNER BUBENZER AB, Borlänge (SE)

( * ) Notice: Subject to any disclaimer, the term of this patent is extended or adjusted under 35 U.S.C. 154(b) by 54 days.

(21) Appl. No.: 18/864,157

(22) PCT Filed: Mar. 17, 2023

(86) PCT No.: PCT/EP2023/056846
§ 371 (c)(1),
(2) Date: Nov. 8, 2024

(87) PCT Pub. No.: WO2024/012725
PCT Pub. Date: Jan. 18, 2024

(65) Prior Publication Data

US 2025/0296606 A1 Sep. 25, 2025

(30) Foreign Application Priority Data

Jul. 12, 2022 (EP) ..... 22184280

(51) Int. Cl.
*B61L 15/00* (2006.01)

(52) U.S. Cl.
CPC ..... *B61L 15/0018* (2013.01); *B61L 15/0072* (2013.01); *B61L 15/0081* (2013.01)

(58) Field of Classification Search
CPC ..... B16L 15/0018; B16L 15/0072; B16L 15/0081
See application file for complete search history.

(56) References Cited

U.S. PATENT DOCUMENTS

2001/0029419 A1 10/2001 Matsumoto et al.
2014/0365098 A1* 12/2014 Lawry ..... B60W 30/1819 701/84

(Continued)

FOREIGN PATENT DOCUMENTS

DE 102018111982 A1 11/2019
EP 3483029 A1 5/2019

*Primary Examiner* — Long T Tran
(74) *Attorney, Agent, or Firm* — Dilworth & Barrese, LLP.; Michael J. Musella, Esq.

(57) ABSTRACT

A rail vehicle (100) obtains a basic parameter (μ) reflecting an initial value of a friction coefficient ($\mu_e$) relating to a rail segment (310) in a railway network (300) and validates the basic parameter (μ) through a procedure involving: measuring individual rotational speeds ($\omega_1$, $\omega_2$, $\omega_3$, $\omega_4$) of the axels to which the wheels (151, 152, 153, 154) of the rail vehicle (100) are connected while applying a gradually increasing brake force (BF) to a specific one of said axles; determining, while applying the gradually increasing brake force (BF), an absolute difference between the rotational speed ($\omega_2$) of the specific one of said axles and an average rotational speed of said axles except the specific one of said axles; and in response to the absolute difference exceeding a threshold value deriving a parameter ($\mu_m$) reflecting a measured value of the friction coefficient ($\mu_e$); checking whether the measured value of the friction coefficient ($\mu_e$) lies within an acceptance interval from the basic parameter (μ); and if so, assigning the validated value of the friction coefficient equal to the measured value of the friction coefficient ($\mu_e$). Then, a friction data message (M(μe)) is emitted that contains the validated value of the friction coefficient.

22 Claims, 2 Drawing Sheets

(56) References Cited

U.S. PATENT DOCUMENTS

| | | | | |
|---|---|---|---|---|
| 2016/0318497 | A1* | 11/2016 | Wright | B60T 17/228 |
| 2017/0309093 | A1* | 10/2017 | Feng | B60W 10/10 |
| 2019/0031214 | A1* | 1/2019 | Yoshida | B61H 11/14 |
| 2019/0135311 | A1* | 5/2019 | Zarella | B61L 15/0072 |
| 2019/0359189 | A1* | 11/2019 | Rasel | B60T 8/1705 |
| 2021/0114570 | A1* | 4/2021 | Hirokawa | B60T 8/1761 |
| 2021/0146895 | A1* | 5/2021 | Tsugoshi | B60T 13/665 |
| 2023/0294524 | A1* | 9/2023 | Wright | B60L 7/26 702/22 |

* cited by examiner

DATA COMMUNICATION SYSTEM, COMPUTER-IMPLEMENTED METHOD FOR DATA COMMUNICATION IN A RAILWAY NETWORK, COMPUTER PROGRAM AND NON-VOLATILE DATA CARRIER

TECHNICAL FIELD

The present invention relates generally to safety arrangements for rail vehicle braking systems. Especially, the invention relates to a data communication system for a railway network according to the preamble of claim 1 and a corresponding computer-implemented method. The invention also relates to a computer program and a non-volatile data carrier storing such a computer program.

BACKGROUND

In operation of an electrically powered rail vehicle, the onboard motors are typically engaged as generators to decelerate the rail vehicle. However, for efficiency and safety reasons, one cannot rely solely on this braking strategy. In particular, a dedicated brake function will always be needed to ensure emergency braking functionality and that the rail vehicle remains stationary after that it has been brought to a stop. In many cases, the same brake units are used for different types of braking functionality, such as service braking, emergency braking and parking braking.

To accomplish efficient retardation of a rail vehicle it is crucial to have accurate knowledge about which braking distance can be expected. The expected braking distance, in turn, is highly dependent on the adhesion conditions at the wheel-rail interface, i.e. the applicable kinetic friction coefficient.

Today, systems exist for informing rail vehicles about various characteristics of different track segments in a railway network, such that the rail vehicles may adapt their driving behavior accordingly.

For example, US 2007/0219682 shows a system for providing at least one of train information and track characterization information for use in train performance, including a first element to determine a location of a train on a track segment and/or a time from a beginning of the trip. A track characterization element to provide track segment information, and a sensor for measuring an operating condition of at least one of the locomotives in the train are also included. A database is provided for storing track segment information and/or the operating condition of at least one of the locomotives. A processor is also included to correlate information from the first element, the track characterization element, the sensor, and/or the database, so that the database may be used for creating a trip plan that optimizes train performance in accordance with one or more operational criteria for the train.

WO 2022/006614 describes a method for improving braking performance of a rail vehicle, the method comprising the steps of: a) Associating one or more sensors with one or more components of the rail vehicle, at least one of the one or more sensors comprising an acoustic sensor configured to detect acoustic signals emitted from a wheel-rail interface; b) Acquiring measurements of one or more operating parameters of the rail vehicle using the one or more sensors; c) Transmitting the measurements of the one or more operating parameters to an operating parameter monitoring device; d) Converting, using a computing circuit of the operating parameter monitoring device, the measurements into an output signal message including information relating to the one or more components of the rail vehicle and/or to adhesion conditions at the wheel-rail interface; and e) Transmitting the output signal message electronically to one or more recipients.

US 2010/0023190 discloses a system for controlling a railroad train over a segment of track. The system comprises a first element for determining a location of the train on the segment of track; a second element for providing track characterization information for the segment of track; the track characterization information related to physical conditions of the segment of track; and a processor for controlling applied tractive forces and braking forces of the train responsive to the location of the train and the track characterization information to reduce at least one of wheel wear and/or track wear during operation of the train over the segment of track.

Although the above systems may offer dissemination of information with potential relevance for determining an expected braking distance, these system generally provide data of unsatisfactory quality. It is therefore not possible to determine a reliable estimate of the braking distance. Consequently, unnecessarily large safety margins between the rail vehicles must be applied, which results in suboptimal throughput of the railroad network.

SUMMARY

The object of the present invention is to solve the above problems and offer a solution that enables rail vehicles to obtain up-to-date high-quality information about applicable adhesion conditions at the wheel-rail interface in various parts of a railway network.

According to one aspect of the invention, the object is achieved by a data communication system for a railway network, which system contains at least one measurement controller, at least one transmitter apparatus and a set of receiver apparatuses. The at least one measurement controller is configured to be comprised in a respective one of at least one rail vehicle of a data-supplier type. The at least one measurement controller is configured to obtain a basic parameter reflecting an initial value of a friction coefficient relating to a rail segment, e.g. via an incoming message or as a default value. The at least one measurement controller is further configured to produce a validated value of the basic parameter, which validated value reflects an updated friction coefficient between the rail of the rail segment and the wheels of the respective one of the at least one rail vehicle of the data-supplier type. The validated value, in turn is produced through a procedure involving: measuring individual rotational speeds of the axels to which the wheels of the at least one first rail vehicle are connected while applying a gradually increasing brake force to a specific one of said axles; determining, while applying the gradually increasing brake force, an absolute difference between the rotational speed of the specific one of said axles and an average rotational speed of said axles except the specific one of said axles, and in response to the absolute difference exceeding a threshold value deriving a parameter reflecting measured value of the friction coefficient, checking whether the measured value of the friction coefficient lies within an acceptance interval from the basic parameter, and if so assigning the validated value equal to the measured value of the friction coefficient. The at least one transmitter apparatus is configured to be comprised in a respective one of at least one rail vehicle of the data-supplier type and emit a friction data message containing the validated value of the friction coefficient. Each receiver apparatus in the set of receiver apparatuses is configured to be comprised in a respective one of at least one rail vehicle in the railway network and receive the friction data message.

The above data communication system is advantageous because it allows sharing of verified friction measures, i.e. information based upon which a rail vehicle carrying the receiver apparatus can rely when for example determining an appropriate distance to a rail vehicle in front. This, in turn, enables an improved overall throughput in the railway network.

According to one embodiment of this aspect of the invention, each receiver apparatus in the set of receiver apparatuses is configured to receive the friction data message over a wireless interface, and each of the at least one transmitter apparatus is configured to emit the friction data message over the wireless interface. Thus, friction data may be exchanged efficiently between rail vehicles, for example during travel in the railway network.

According to another embodiment of this aspect of the invention, each of the at least one measurement controller is configured to produce a friction data message containing: the validated value of the friction coefficient, an identification of the rail segment to which the validated value of the friction coefficient relates, and a point in time when the validated value of the friction coefficient was derived. Thereby, any rail vehicle carrying the receiver apparatus may conveniently determine the relevant rail segment to which the friction coefficient relates as well as a reliability of the received information.

According to yet another embodiment of this aspect of the invention, each receiver apparatus in the set of receiver apparatuses is configured to receive at least two friction data messages relating to the rail segment, and derive an updated value of the friction coefficient for the rail segment based on the at least two received friction data messages. Here, the updated value of the friction coefficient is based on a balancing of the validated values of the friction coefficient included in the at least two friction data messages.

For example, the balancing of the validated values of the friction coefficient may involve comparing the validated value of the friction coefficient of each of the at least two received friction data messages to a threshold level for the friction coefficient, and assigning the updated value of the friction coefficient equal to the validated value of the friction coefficient of a latest received message of the at least two received friction data messages, if the validated value of the friction coefficient of the latest received message is lower than or equal to the threshold level. If, however, the latest received message indicates a friction coefficient above the threshold level, the updated value of the friction coefficient is assigned a friction coefficient equal to the threshold level. As a result, it can be guaranteed that the friction coefficient is not assigned an excessively high value.

Alternatively, the balancing of the validated values of the friction coefficient may involve assigning the updated value of the friction coefficient equal to the validated value of the friction coefficient of a latest received message of the at least two received friction data messages without considering any threshold level. Thus, maximum advantage can be taken of the validated value of the friction coefficient.

According to still another embodiment of this aspect of the invention, the system further contains at least one dispatchment node configured to receive the friction data message from one of the at least one transmitter apparatus via the wireless interface and relay the received friction data message to at least one of the receiver apparatuses in the set of receiver apparatuses via the wireless interface. A communication infrastructure in the form of such dispatchment nodes is beneficial because it bridges distance gaps between different rail vehicles and thus ensures that the friction data message are distributed properly to the intended receiver apparatuses.

Preferably, the at least one dispatchment node is configured to receive at least two friction data messages relating to the particular rail segment, derive an updated value of the friction coefficient for the rail segment based on the at least two received friction data messages, and relay the updated value of the friction coefficient for the rail segment to at least one of the receiver apparatuses. Analogous to the above, the updated value of the friction coefficient is based on a balancing of the validated values of the friction coefficient contained in the at least two friction data messages. Hence, friction data may be aggregated and enhanced in the at least one dispatchment node before being distributed to the rail vehicles in the railway network.

In further analogy to the above, the balancing of the validated values of the friction coefficient may involve assigning the updated value of the friction coefficient equal to the validated value of the friction coefficient of a latest received message of the at least two received friction data messages. Alternatively, the validated value of the friction coefficient of each of the at least two received friction data messages may be compared to a threshold level for the friction coefficient, and only if the latest received message contains a validated value of the friction coefficient lower than or equal to the threshold level, the updated value of the friction coefficient is assigned equal to the validated value of the friction coefficient of the latest received message. Otherwise, the updated value of the friction coefficient is assigned a friction coefficient equal to the threshold level. This advantageous for the same reasons as stated above.

According to another aspect of the invention, the object is achieved by a computer-implemented method for data communication in a railway network, which method is implemented in at least one processing circuitry and involves: obtaining, in a measurement controller comprised in a rail vehicle of a data-supplier type, a basic parameter reflecting an initial value of a friction coefficient relating to a rail segment in the railway network, and producing, in the measurement controller, a validated value of the basic parameter. The validated value reflects an updated friction coefficient between the rail of the rail segment and the wheels of the respective one of the at least one rail vehicle of the data-supplier type. The validated value is produced through a procedure involving: measuring individual rotational speeds of the axels to which the wheels of the at least one first rail vehicle are connected while applying a gradually increasing brake force to a specific one of said axles, determining, while applying the gradually increasing brake force, an absolute difference between the rotational speed of the specific one of said axles and an average rotational speed of said axles except the specific one of said axles, and in response to the absolute difference exceeding a threshold value deriving a parameter reflecting a measured value of the friction coefficient, checking whether the measured value of the friction coefficient lies within an acceptance interval from the basic parameter, and if so, assigning the validated value equal to the measured value of the friction coefficient. Moreover, a friction data message is emitted from a transmitter apparatus comprised in the rail vehicle of the data-supplier type, which friction data message contains the validated value of the friction coefficient.

Further, the method involves receiving the friction data message in a receiver apparatus comprised in a rail vehicle in the railway network. The advantages of this method, as well as the preferred embodiments thereof are apparent from the discussion above with reference to the proposed friction testing system.

According to a further aspect of the invention, the object is achieved by a computer program loadable into a non-volatile data carrier communicatively connected to a processing unit. The computer program includes software for executing the above method when the program is run on the processing unit.

According to another aspect of the invention, the object is achieved by a non-volatile data carrier containing the above computer program.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DETAILED DESCRIPTION

Figure 1:
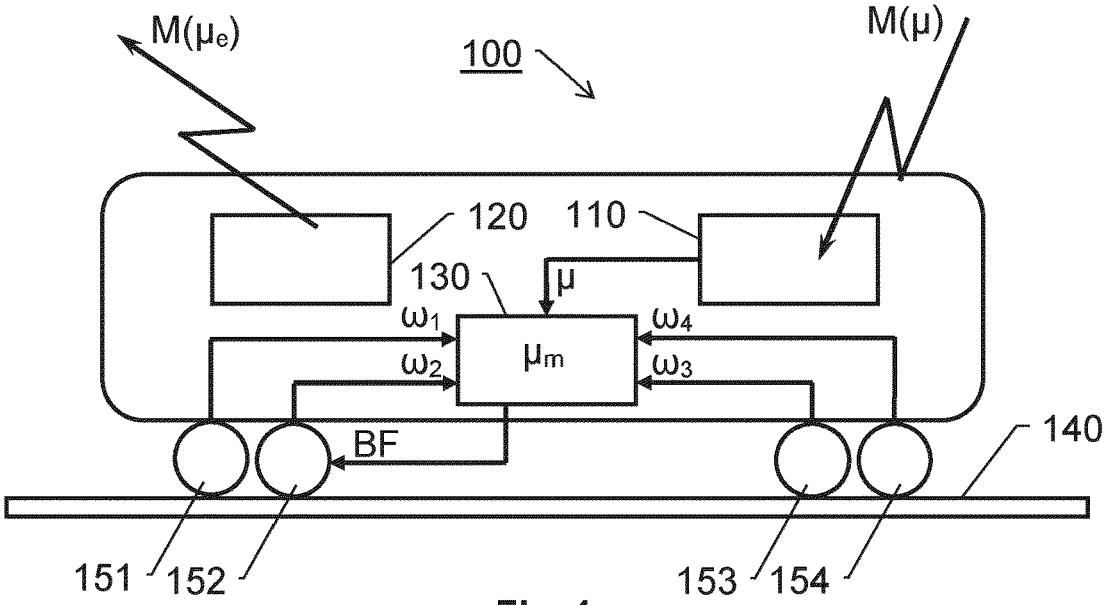
FIG. 1 schematically illustrates a rail vehicle containing equipment that form part of a data communication system according to one embodiment of the invention.
Figure 3:
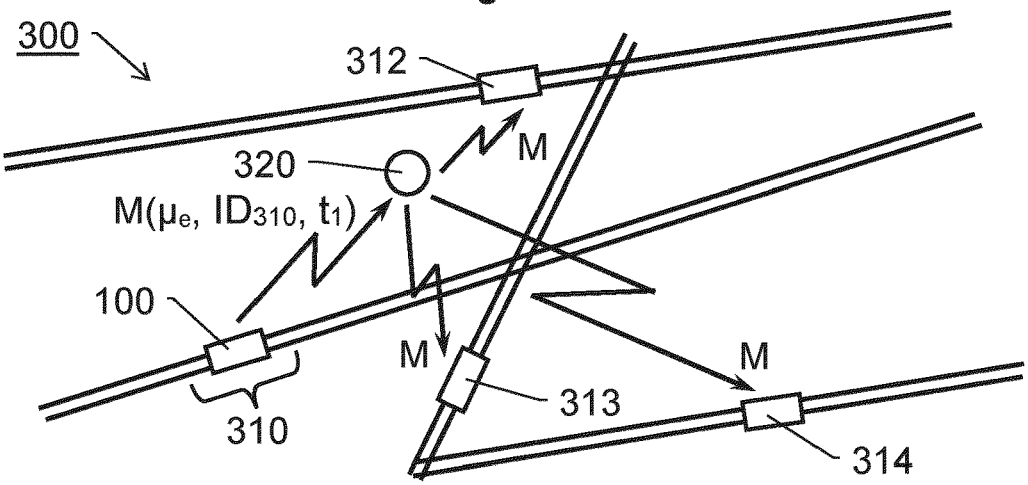
FIG. 3 shows a schematic railway network in which a data communication system according to one embodiment of the invention is implemented.

In FIG. 1, we see a schematic illustration of a rail vehicle 100 containing equipment that form part of a data communication system according to one embodiment of the invention. FIG. 3 shows a schematic railway network 300 in which the proposed data communication system may be implemented.

The data communication system includes a set of receiver apparatuses. FIG. 1 shows an example of such a receiver apparatus 110 that is comprised in the rail vehicle 100 and which receiver apparatus 110 is configured to receive a friction data message M(μ) from at least one other rail vehicle in the railway network 300. The friction data message M(μ) relates to a particular rail segment of the railway network 300, for example as illustrated by 310 in FIG. 3.

The data communication system also includes at least one measurement controller. FIG. 1 shows an example of such a measurement controller 130 that is comprised in the rail vehicle 100. By definition thereby, the rail vehicle 100 is a rail vehicle of a data-supplier type, i.e. a source for producing validated friction information as will be described below.

The measurement controller 130 is configured to obtain a basic parameter μ reflecting an initial value of a friction coefficient $\mu_e$ relating to the rail segment 310. For example, the basic parameter μ may be received in the receiver apparatus 110 via a friction data message M(μ) from another rail vehicle in the railway network 300. Then, the receiver apparatus 110 may forward the basic parameter μ to the measurement controller 130. Alternatively, or in addition, the measurement controller 130 may produce the basic parameter μ, for instance based on a default assumption, or an his-toric entry stored in the rail vehicle 100. Consequently, the basic parameter μ may originate from another rail vehicle in the railway network 300, dedicated friction test equipment performing measurements on the rail segment 310, or the rail vehicle 100 itself, for example through deduction based on neighboring measuring points.

Nevertheless, the measurement controller 130 is configured to produce a validated value of the basic parameter μ. The validated value reflects an updated friction coefficient $\mu_e$ between the rail 140 of the rail segment 310 and the wheels 151, 152, 153 and 154 of the rail vehicle 100 of the data-supplier type. The validated value is produced through a procedure involving the following steps.

First, individual rotational speeds $\omega_1$, $\omega_2$, $\omega_3$ and $\omega_4$ are measured of the respective axels to which the wheels 151, 152, 153 and 154 respectively of the rail vehicle 100 are connected while applying a gradually increasing brake force BF to a specific one of the axles, say 152.

Then, while applying the gradually increasing brake force BF to the specific one of the axles, an absolute difference is determined between the rotational speed $\omega_2$ of the specific one of the axles and an average rotational speed of the other axles, i.e. all the axles except the specific one of the axles. In response to the absolute difference exceeding a threshold value, a parameter $\mu_m$ is derived that reflects a measured value of the friction coefficient $\mu_e$.

The measurement controller 130 is further configured to check whether the measured value of the friction coefficient $\mu_e$ lies within an acceptance interval from the basic parameter μ, say ±10%, from the initial value of the friction coefficient $\mu_e$. If the measured value of the friction coefficient $\mu_e$ lies within the acceptance interval, the measurement controller 130 is configured to assign the validated value equal to the measured value of the friction coefficient $\mu_e$. Of course, the acceptance interval need not be ±10%. On the contrary, any wider or narrower extension of this interval is likewise conceivable.

If, however, the measured value of the friction coefficient $\mu_e$ does not lie within the acceptance interval, the measurement controller 130 is preferably configured to repeat the above steps to derive a new measured value of the friction coefficient $\mu_e$.

Figure 2:
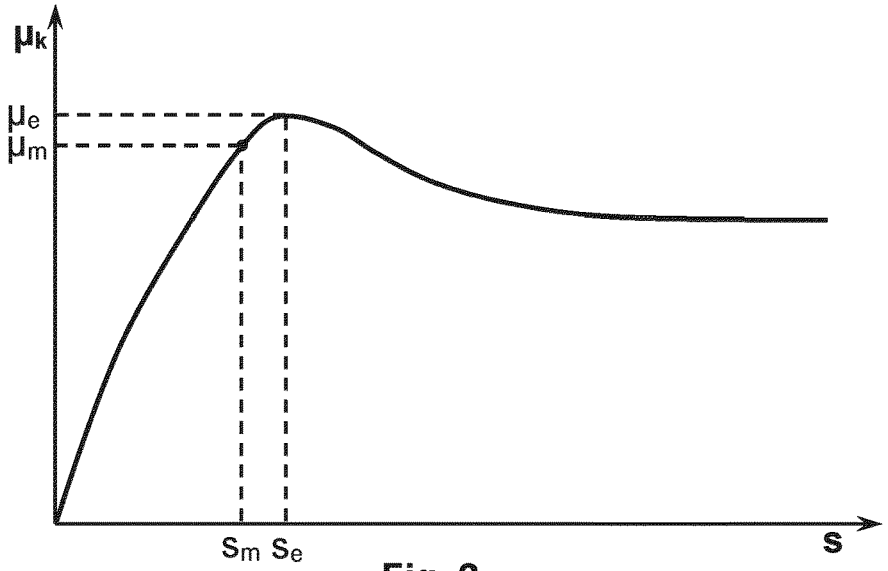
FIG. 2 shows a graph illustrating an example of the friction coefficient as a function of wheel slippage.

Referring now to FIG. 2, we will explain how the validated value of the friction coefficient $\mu_e$ may be derived by studying the absolute difference between the rotational speed $\omega_2$ of the specific one of the axles and the average rotational speed of the other axles $\omega_1$, $\omega_3$ and $\omega_4$ while applying the gradually increased braking force to the specific one of the axles. FIG. 2 shows a graph illustrating an example of how the kinetic friction coefficient $\mu_k$ is expressed as a function of the wheel slippage s, which here is understood to designate a common term for a sliding or spinning motion of the wheel relative to the rail. In other words, the wheel slippage s is applicable to retardation as well as acceleration.

Characteristically, the kinetic friction coefficient $\mu_k$ increases relatively proportionally with increasing wheel slippage s. When approaching a peak value $\mu_e$, however, the kinetic friction coefficient $\mu_k$ levels out somewhat. The friction coefficient peak value $\mu_e$ is associated with an optimal wheel slippage $s_e$ after which a further increase of wheel slippage s results in a gradually reduced kinetic friction coefficient $\mu_k$.

According to the invention, a parameter $\mu_m$ is determined that reflects the friction coefficient between the rail vehicle's 100 wheels and the rails upon which the rail vehicle 100 travels. Ideally, the peak value $\mu_e$ should be derived. For example, the peak value $\mu_e$ may be derived as follows. When the absolute difference $|\omega_2-\omega_a|$ between the first and second wheel speed signals $\omega_2$ and $\omega_a$ exceeds the threshold value, this corresponds to a situation where the at least one wheel 152 on the specific one of the wheel axles experiences a wheel slippage $s_m$ near the optimal wheel slippage $s_e$. The kinetic friction coefficient $\mu_k$ is given by the expression:

$$\mu_k = \frac{F}{m \cdot g}$$

where F is the force applied by the brake unit, m is the mass of the rail vehicle 100, and g is the standard acceleration due to gravity.

Under the assumption that the wheel slippage $s_m$ is near the optimal wheel slippage $s_e$, the peak value $\mu_e$ of the kinetic friction coefficient $\mu_k$ may be estimated relatively accurately.

In addition to the above, the data communication system according to the invention includes at least one transmitter apparatus, which in FIG. 1 is exemplified by the unit 120 comprised in the rail vehicle 100 of the data-supplier type. The transmitter apparatus is configured to emit the friction data message $M(\mu_e)$ containing the validated value of the friction coefficient $\mu_e$, such that at least one other rail vehicle in the railway network 300 may obtain information about said validated value by receiving the friction data message $M(\mu_e)$.

Consequently, each of the at least one rail vehicle 100, 312, 313 and 314 in the railway network 300 that is equipped with a receiver apparatuses 110 can make use of the validated value of the friction coefficient $\mu_e$, for example when keeping a particular distance to a rail vehicle in front and/or when service braking.

It is preferable if the measurement controller 130 is configured to produce the friction data message $M(\mu_e)$ such that it contains not only the validated value of the friction coefficient $\mu_e$, however also an identification of the rail segment to which the validated value of the friction coefficient $\mu_e$ relates and a timestamp designating a point in time when the validated value of the friction coefficient He was derived. FIG. 3 exemplifies this by showing a friction data message $M(\mu_e, ID_{310}, t_1)$ including an identification $ID_{310}$ of the rail segment 310 to which the validated value of the friction coefficient $\mu_e$ relates, and a point in time $t_1$ when the validated value of the friction coefficient $\mu_e$ was derived.

Preferably, each receiver apparatus 110 is configured to receive the validated value of the friction coefficient $\mu_e$ over a wireless interface via the friction data messages $M(\mu_e)$, and each transmitter apparatus 120 is configured to emit the validated value of the friction coefficient $\mu_e$ over the wireless interface via the friction data messages $M(\mu_e)$. Namely, this allows for conve-nient sharing of high-quality friction information between the different rail vehicles 100, 312, 313 and 314 in the railway network 300.

To maintain accurate and updated records about the adhesion conditions at the wheel-rail interface in the railway network 300, according to one embodiment of the invention, each receiver apparatus 110 is configured to receive at least two friction data messages $M(\mu_e)$ relating to the same rail segment, say 310, and derive an updated value of the friction coefficient for the rail segment 310 based on the at least two received friction data messages $M(\mu_e)$. The updated value of the friction coefficient is based on a balancing of the validated values of the friction coefficient $\mu_e$ included in the at least two friction data messages $M(\mu_e)$. Technically, however, the balancing may involve any kind of weighing together of the validated values of the friction coefficient $\mu_e$, such as calculating average or median value.

According to one embodiment of the invention, the balancing of the validated values of the friction coefficient $\mu_e$ involves comparing the validated value of the friction coefficient $\mu_e$ of each of the at least two received friction data messages $M(\mu_e)$ to a threshold level for the friction coefficient. If the validated value of the friction coefficient $\mu_e$ of a latest received message is lower than or equal to the threshold level, the updated value of the friction coefficient is assigned equal to the validated value of the friction coefficient $\mu_e$ of the latest received message of the at least two received friction data messages $M(\mu_e)$. Otherwise, the updated value of the friction coefficient is assigned a friction coefficient equal to the threshold level. Thus, the friction coefficient will never be assigned a better/higher value than the threshold level. This facilitates complying with regulatory requirements that may prescribe maximum values for the friction coefficient.

Alternatively, according to another embodiment of the invention, the balancing of the validated values of the friction coefficient $\mu_e$ involves assigning the updated value of the friction coefficient equal to the validated value of the friction coefficient $\mu_e$ of a latest received message of the at least two received friction data messages $M(\mu_e)$, i.e. without considering any maximum value for the friction coefficient.

Referring again to FIG. 3, according to one embodiment of the invention, the data communication system contains at least one dispatchment node 320. Each dispatchment node 320 is configured to receive the friction data message $M(\mu_e, ID_{310}, t_1)$ from at least one transmitter apparatus 120 via the wireless interface. Here, a rail vehicle 100 comprises a transmitter apparatus 120 that emits the friction data message $M(\mu_e, ID_{310}, t_1)$. Moreover, each dispatchment node 320 is configured to relay the received friction data message M to at least one of the receiver apparatuses 110 in the set of receiver apparatuses via the wireless interface. Here, a respective receiver apparatus in each of the rail vehicles 312, 313 and 314 respectively receives the friction data message $M(\mu_e, ID_{310}, t_1)$ from the dispatchment node 320. Consequently, it is sufficient for the rail vehicles 100, 312, 313 and 314 to be communicatively connected to at least one dispatchment node 320 in order to exchange friction information with other rail vehicles in the railroad network 300.

According to one embodiment of the invention, the dispatchment node 320 is configured to receive at least two friction data messages $M(\mu_e, ID_{310}, t_1)$ relating to a particular rail segment, say 310. The dispatchment node 320 is further configured to derive an updated value of the friction coefficient for the rail segment 310 based on the at least two received friction data messages $M(\mu_e, ID_{310}, t_1)$. Analogous to the above, the updated value of the friction coefficient is based on a balancing of the validated values of the friction coefficient $\mu_e$ comprised in the at least two friction data messages $M(\mu_e, ID_{310}, t_1)$. The dispatchment node 320 is configured to relay the updated value of the friction coefficient for the rail segment 310 to at least one of the receiver apparatuses 110 by emitting a friction data message M over the wireless interface.

In further analogy to the above, according to one embodiment of the invention, the balancing of the validated values of the friction coefficient $\mu_e$ involves comparing the validated value of the friction coefficient $\mu_e$ of each of the at least two received friction data messages $M(\mu_e, ID_{310}, t_1)$ to a threshold level for the friction coefficient, assigning the updated value of the friction coefficient equal to the validated value of the friction coefficient $\mu_e$ of a latest received message of the at least two received friction data messages $M(\mu_e, ID_{310}, t_1)$, if the validated value of the friction coefficient $\mu_e$ of the latest received message is lower than or equal to the threshold level. Otherwise, the dispatchment node 320 is configured to assign the updated value of the friction coefficient to a friction coefficient equal to the threshold level.

Alternatively, according to one embodiment of the invention, the balancing of the validated values of the friction coefficient $\mu_e$ effected by the dispatchment node 320 simply involves assigning the updated value of the friction coefficient equal to the validated value of the friction coefficient $\mu_e$ of the latest received message of the at least two received friction data messages $M(\mu_e, ID_{310}, t_1)$.

Figure 4:
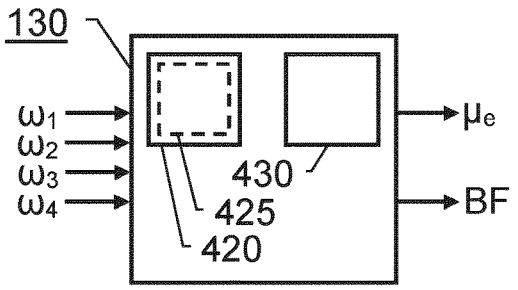
FIG. 4 shows a block diagram of a measurement controller according to one embodiment of the invention.

FIG. 4 shows a block diagram of the measurement controller 130 according to one embodiment of the invention. The measurement controller 130 includes processing circuitry in the form of at least one processor 430 and a memory unit 420, i.e. non-volatile data carrier, storing a computer program 425, which, in turn, contains software for making the at least one processor 430 execute the actions mentioned in this disclosure when the computer program 425 is run on the at least one processor 430.

Figure 5:
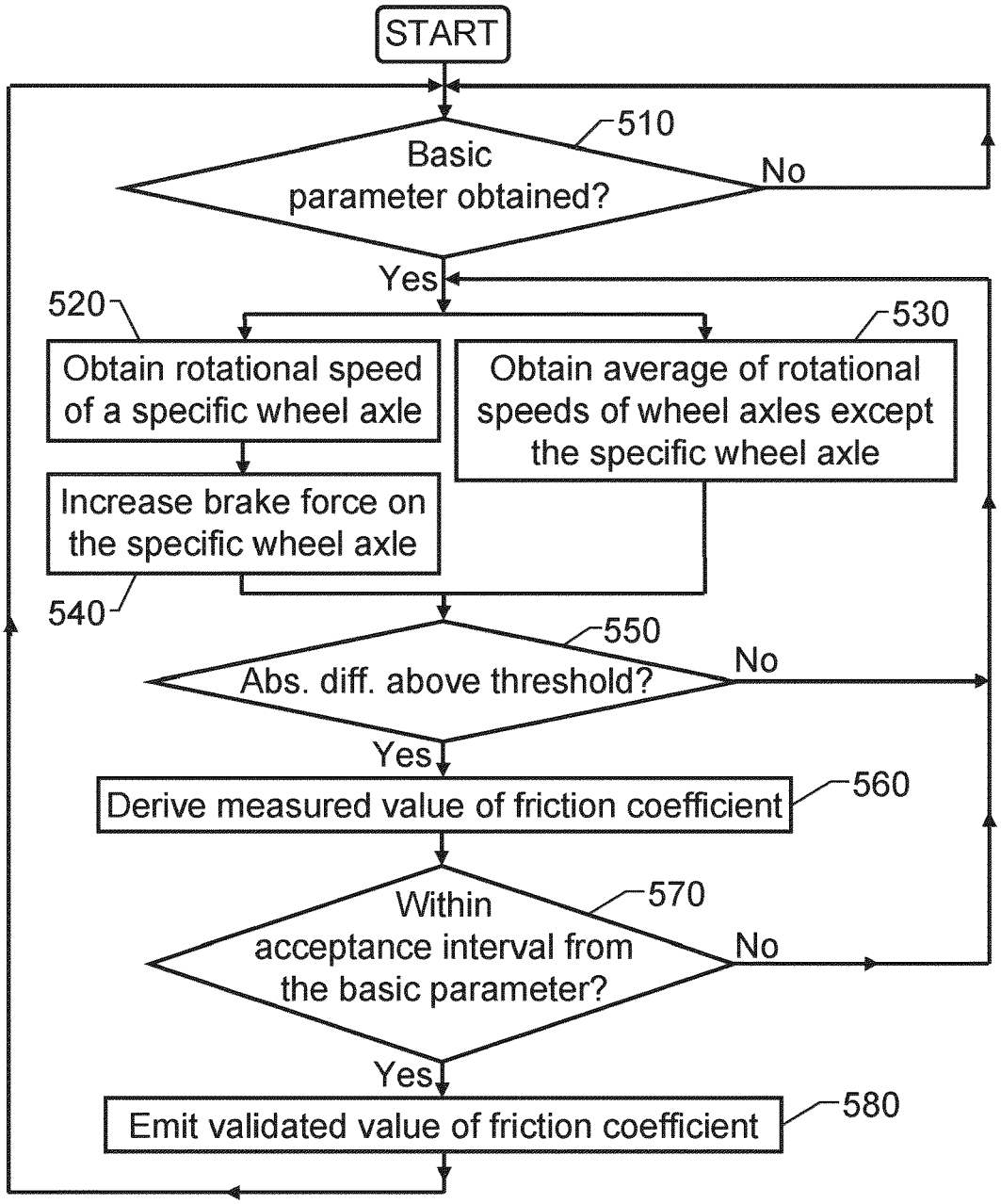
FIG. 5 illustrates, by means of a flow diagram, a preferred embodiment of method according to the invention.

In order to sum up, and with reference to the flow diagram in FIG. 5, we will now describe the computer-implemented method for data communication in a railway network 300 that is carried out by the measurement controller 130 according to a preferred embodiment of the invention.

In a first step 510, it is checked whether a basic parameter $\mu$ has been obtained, which basic parameter $\mu$ reflects an initial value of a friction coefficient $\mu_e$ relating to a particular rail segment 310 in the railway network 300. If the basic parameter $\mu$ has been obtained, for example via a received friction data message $M(\mu)$, steps 520 and 530 follow; and otherwise, the procedure loops back and stays in step 510.

A validated value of the basic parameter $\mu$ is produced by executing steps 520 to 570. The validated value reflects an updated friction coefficient $\mu_e$ between the rail 140 of the rail segment 310 and the wheels the rail vehicle 100 of the data-supplier type, i.e. in which the procedure is executed.

In step 520, a rotational speed of a specific one of the wheel axles of the rail vehicle 100 of the data-supplier type is obtained, and in step 530, preferably parallel to step 520, an average rotational speed of the axles except the specific one of the axles is obtained.

In a step 540 following step 520, a brake force BF is applied to the specific one of the axles, and in a step 550 subsequent to steps 540 and 530, it is checked if an absolute difference between the rotational speed of the specific one of the axles and the average rotational speed of the axles except the specific one of the axles exceeds a threshold value. If so, a step 560 follows; and otherwise, the procedure loops back to steps 520 and 530. Next time, when reaching step 540, the brake force BF is applied at a somewhat larger magnitude than last time, such that for each run through the loop the brake force BF is gradually increased.

In step 560, a parameter $\mu_m$ is derived, which reflects a measured value of the friction coefficient $\mu_e$. The measured value of the friction coefficient $\mu_e$ is derived as described above referring to FIG. 2.

Thereafter, a step 570 checks if the measured value of the friction coefficient $\mu_e$ lies within an acceptance interval from the friction coefficient $\mu_e$ reflected by the basic parameter $\mu$ obtained in step 510. If the measured value of the friction coefficient $\mu e$ is found to lie within the acceptance interval, the validated value of the basic parameter $\mu$ is assigned equal to the measured value of the friction coefficient $\mu_e$, and a step 580 follows. Otherwise, the procedure loops back to steps 520 and 530 for deriving a new measured value of the friction coefficient $\mu e$.

In step 580, a message $M(\mu_e)$ containing the validated value of the basic parameter $\mu$ is emitted, for example over a wireless interface, so that it may be received by other rail vehicles in the railway network 300. After that, the procedure loops back to step 510.

All of the process steps, as well as any sub-sequence of steps, described with reference to FIG. 5 may be controlled by means of a programmed processor. Moreover, although the embodiments of the invention described above with reference to the drawings comprise processor and processes per-formed in at least one processor, the invention thus also extends to computer programs, particularly computer programs on or in a carrier, adapted for putting the invention into practice. The program may be in the form of source code, object code, a code intermediate source and object code such as in partially compiled form, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read-Only Memory), an EEPROM (Electrically Erasable Programmable Read-Only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal, which may be conveyed, directly by a cable or other device or means, the carrier may be constituted by such cable or device or means. Alternatively, the carrier may be an integrated circuit in which the program is embedded, the integrated circuit being adapted for performing, or for use in the performance of, the relevant processes.

The term "comprises/comprising" when used in this specification is taken to specify the presence of stated features, integers, steps or components. The term does not preclude the presence or addition of one or more additional elements, features, integers, steps or components or groups thereof. The indefinite article "a" or "an" does not exclude a plurality. In the claims, the word "or" is not to be interpreted as an exclusive or (sometimes referred to as "XOR"). On the contrary, expressions such as "A or B" covers all the cases "A and not B", "B and not A" and "A and B", unless otherwise indicated. The mere fact that certain measures are recited in mutually different dependent claims does not indicate that a combination of these measures cannot be used to advantage. Any reference signs in the claims should not be construed as limiting the scope.

It is also to be noted that features from the various embodiments described herein may freely be combined, unless it is explicitly stated that such a combination would be unsuitable.

Variations to the disclosed embodiments can be understood and effected by those skilled in the art in practicing the claimed invention, from a study of the drawings, the disclosure, and the appended claims.

The invention is not restricted to the described embodiments in the figures, but may be varied freely within the scope of the claims.

The invention claimed is:

1. A data communication system for a railway network (300), which comprises:

at least one measurement controller (130) configured to:

in a respective one of at least one rail vehicle (100) of a data-supplier type, obtain a basic parameter (μ) reflecting an initial value of a friction coefficient (με) relating to a rail segment (310) in the railway network (300), and produce a validated value of the basic parameter (μ), which validated value reflects an updated friction coefficient (με) between the rail (140) of the rail segment (310) and the wheels (151, 152, 153, 154) of the respective one of the at least one rail vehicle (100) of the data-supplier type, and which validated value is produced through a procedure involving:

measuring individual rotational speeds (ω1, ω2, ω3, ω4) of the axles to which the wheels (151, 152, 153, 154) of the at least one first rail vehicle are connected while applying a gradually increasing brake force (BF) to a specific one of said axles, determining, while applying the gradually increasing brake force (BF), an absolute difference between the rotational speed (ω2) of the specific one of said axles and an average rotational speed of said axles except the specific one of said axles, and in response to the absolute difference exceeding a threshold value, deriving a parameter (μm) reflecting a measured value of the friction coefficient (με), checking whether the measured value of the friction coefficient (με) lies within an acceptance interval from the basic parameter (μ), and if so assigning the validated value equal to the measured value of the friction coefficient (με), and at least one transmitter apparatus (120) configured to:

in a respective one of at least one rail vehicle (100) of the data supplier type, and emit a friction data message (M(με)) containing the validated value of the friction coefficient (με); and a set of receiver apparatuses (110) each of which is configured to:

in at least one rail vehicle (100, 312, 313, 314) in the railway network (300), receive the friction data message (M(με)).

2. The system according to claim 1, wherein:

each receiver apparatus (110) in the set of receiver apparatuses is configured to receive the friction data message (M(με)) over a wireless interface, and each of the at least one transmitter apparatus (120) is configured to emit the friction data message (M(με)) over the wireless interface.

3. The system according to claim 2, wherein each of the at least one measurement controller (130) is configured to produce the friction data message (M(με), M(με, ID310, t1)) to comprise:

the validated value of the friction coefficient (με), an identification (ID310) of the rail segment (310) to which the validated value of the friction coefficient (με) relates, and a point in time (t1) when the validated value of the friction coefficient (με) was derived.

4. The system according to claim 3, wherein each receiver apparatus (110) in the set of receiver apparatuses is configured to:

receive at least two friction data messages (M(με)) relating to the rail segment (310), and derive an updated value of the friction coefficient for the rail segment (310) based on the at least two received friction data messages (M(με)), which updated value of the friction coefficient is based on a balancing of the validated values of the friction coefficient (με) in the at least two friction data messages (M(με)).

5. The system according to claim 4, wherein the balancing of the validated values of the friction coefficient (με) comprises:

comparing the validated value of the friction coefficient (με) of each of the at least two received friction data messages (M(με)) to a threshold level for the friction coefficient, and assigning the updated value of the friction coefficient equal to the validated value of the friction coefficient (με) of a latest received message of the at least two received friction data messages (M(με)) if the validated value of the friction coefficient (με) of the latest received message is lower than or equal to the threshold level, and otherwise assigning the updated value of the friction coefficient a friction coefficient equal to the threshold level.

6. The system according to claim 4, wherein the balancing of the validated values of the friction coefficient (με) comprises:

assigning the updated value of the friction coefficient equal to the validated value of the friction coefficient (με) of a latest received friction data message of the at least two received friction data messages (M(με)).

7. The system according to claim 3, further comprising:

at least one dispatchment node (320) configured to receive the friction data message (M(με, ID310, t1)) from one of the at least one transmitter apparatus (120) via the wireless interface and relay the received friction data message (M) to at least one of the receiver apparatuses (110) in the set of receiver apparatuses via the wireless interface.

8. The system according to claim 7, wherein the at least one dispatchment node (320) is configured to:

receive at least two friction data messages (M(με, ID310, t1)) relating to the particular rail segment (310), derive an updated value of the friction coefficient for the rail segment (310) based on the at least two received friction data messages (M(με, ID310, t1)), which updated value of the friction coefficient is based on a balancing of the validated values of the friction coefficient (με) in the at least two friction data messages (M(με, ID310, t1)), and relay the updated value of the friction coefficient for the rail segment (310) to at least one of the receiver apparatuses (110) in the set of receiver apparatuses via a friction data message (M) emitted over the wireless interface.

9. The system according to claim 8, wherein the balancing of the validated values of the friction coefficient (με) comprises:

comparing the validated value of the friction coefficient (με) of each of the at least two received friction data messages (M(με, ID310, t1)) to a threshold level for the friction coefficient, and assigning the updated value of the friction coefficient equal to the validated value of the friction coefficient (με) of a latest received message of the at least two received friction data messages (M(με, ID310, t1)) if the validated value of the friction coefficient (με) of the latest received message is lower than or equal to the threshold level, and otherwise assigning the updated value of the friction coefficient a friction coefficient equal to the threshold level.

10. The system according to claim 8, wherein the balancing of the validated values of the friction coefficient (μe) comprises:

assigning the updated value of the friction coefficient equal to the validated value of the friction coefficient (μe) of a latest received message of the at least two received friction data messages (M(μe, ID310, t1)).

11. A computer-implemented method for data communication in a railway network (300), which is implemented in at least one processing circuitry (430) and comprises:

obtaining, in a measurement controller (130) in a rail vehicle (100) of a data-supplier type, a basic parameter (μ) reflecting an initial value of a friction coefficient (μe) relating to the a segment (310) in the railway network (300), producing, in the measurement controller (130), a validated value of the basic parameter (μ), which validated value reflects an updated friction coefficient (μe) between the rail (140) of the rail segment (310) and the wheels (151, 152, 153, 154) of the respective one of the at least one rail vehicle (100) of the data-supplier type, and which validated value is produced through a procedure involving:

measuring individual rotational speeds (ω1, ω2, ω3, ω4) of the axles to which the wheels (151, 152, 153, 154) of the at least one first rail vehicle are connected while applying a gradually increasing brake force (BF) to a specific one of said axles, determining, while applying the gradually increasing brake force (BF), an absolute difference between the rotational speed (ω2) of the specific one of said axles and an average rotational speed of said axles except the specific one of said axles, and in response to the absolute difference exceeding a threshold value, deriving a parameter (μm) reflecting a measured value of the friction coefficient (μe), checking whether the measured value of the friction coefficient (μe) lies within an acceptance interval from the basic parameter (μ), and if so assigning the validated value equal to the measured value of the friction coefficient (μe), and emitting, from a transmitter apparatus (120) in the rail vehicle (100) of the data-supplier type, a friction data message (M(μe)) containing the validated value of the friction coefficient (μe); and receiving, in a receiver apparatus (110) in a rail vehicle (100, 312, 313, 314) in the railway network (300), the friction data message (M(μe)).

12. The method according to claim 11, comprising:

receiving, in each receiver apparatus (110) in the set of receiver apparatuses, the friction data message (M(μe)) over a wireless interface, and emitting, from each of the at least one transmitter apparatus (120), the friction data message (M(μe)) over the wireless interface.

13. The method according to claim 12, comprising:

producing, in each of the at least one measurement controller (130), the friction data message (M(μe), M(μe, ID310, t1)) to comprise the validated value of the friction coefficient (μe), an identification (ID310) of the rail segment (310) to which the validated value of the friction coefficient (μe) relates, and a point in time (t1) when the validated value of the friction coefficient (μe) was derived.

14. The method according to claim 13, comprising, in each receiver apparatus (110) in the set of receiver apparatuses:

receiving at least two friction data messages (M(μe)) relating to the rail segment (310), and deriving an updated value of the friction coefficient for the rail segment (310) based on the at least two received friction data messages (M(μe)), which updated value of the friction coefficient is based on a balancing of the validated values of the friction coefficient (μe) in the at least two friction data messages (M(μe)).

15. The method according to claim 14, wherein the balancing of the validated values of the friction coefficient (μe) comprises:

comparing the validated value of the friction coefficient (μe) of each of the at least two received friction data messages (M(μe)) to a threshold level for the friction coefficient, and assigning the updated value of the friction coefficient equal to the validated value of the friction coefficient (μe) of a latest received message of the at least two received friction data messages (M(μe)) if the validated value of the friction coefficient (μe) of the latest received message is lower than or equal to the threshold level, and otherwise assigning the updated value of the friction coefficient a friction coefficient equal to the threshold level.

16. The method according to claim 14, wherein the balancing of the validated values of the friction coefficient (μe) comprises:

assigning the updated value of the friction coefficient equal to the validated value of the friction coefficient (μe) of a latest received message of the at least two received friction data messages (M(μe)).

17. The method according to claim 13, further comprising:

receiving, in at least one dispatchment node (320), the friction data message (M(μe, ID310, t1)) from one of the at least one transmitter apparatus (120) via the wireless interface, and relaying the received friction data message (M) to at least one of the receiver apparatuses (110) in the set of receiver apparatuses via the wireless interface.

18. The method according to claim 17, further comprising, in the dispatchment node:

receiving at least two friction data messages (M(μe, ID310, t1)) relating to the particular rail segment (310), deriving an updated value of the friction coefficient for the rail segment (310) based on the at least two received friction data messages (M(μe, ID310, t1)), which updated value of the friction coefficient is based on a balancing of the validated values of the friction coefficient (μe) in the at least two friction data messages (M(ue, ID310, t1)), and relaying the updated value of the friction coefficient for the rail segment (310) to at least one of the receiver apparatuses (110) in the set of receiver apparatuses via a friction data message (M) emitted over the wireless interface.

19. The method according to claim 18, wherein the balancing of the validated values of the friction coefficient (μe) comprises:

comparing the validated value of the friction coefficient (μe) of each of the at least two received friction data messages (M(μe, ID310, t1)) to a threshold level for the friction coefficient, and assigning the updated value of the friction coefficient equal to the validated value of the friction coefficient (μe) of a latest received message of the at least two received friction data messages (M(μe, ID310, t1)) if the validated value of the friction coefficient (μe) of the latest received message is lower than or equal to the threshold level, and otherwise assigning the updated value of the friction coefficient a friction coefficient equal to the threshold level.

20. The method according to claim 18, wherein the balancing of the validated values of the friction coefficient (μe) comprises:

assigning the updated value of the friction coefficient equal to the validated value of the friction coefficient (μe) of a latest received message of the at least two received friction data messages (M(μe, ID310, t1)).

21. A computer program (425) loadable into a non-volatile data carrier (420) communicatively connected to at least one processor (430), the computer program (425) comprising software for executing the method according to claim 11 when the computer program (425) is run on the at least one processor (430).

22. A non-volatile data carrier (420) containing the computer program (425) of the claim 21.

* * * * *